US010099278B2

(12) United States Patent
Uchida et al.

(10) Patent No.: US 10,099,278 B2
(45) Date of Patent: Oct. 16, 2018

(54) MOLD-MAKING DEVICE AND MOLD-MAKING METHOD

(71) Applicant: Shintokogio, Ltd.

(72) Inventors: Kazumasa Uchida, Aichi (JP); Masaomi Mitsutake, Aichi (JP); Hirotsune Watanabe, Aichi (JP); Takumi Maegawa, Aichi (JP); Masashi Morikawa, Aichi (JP); So Nakayama, Aichi (JP); Tomokazu Suda, Aichi (JP); Toshihiko Zenpo, Aichi (JP)

(73) Assignee: Sintokogio, Ltd. (JP)

( * ) Notice: Subject to any disclaimer, the term of this patent is extended or adjusted under 35 U.S.C. 154(b) by 201 days.

(21) Appl. No.: 14/779,590

(22) PCT Filed: Feb. 7, 2014

(86) PCT No.: PCT/JP2014/052936
§ 371 (c)(1),
(2) Date: Sep. 24, 2015

(87) PCT Pub. No.: WO2014/156332
PCT Pub. Date: Oct. 2, 2014

(65) Prior Publication Data

US 2016/0052047 A1 Feb. 25, 2016

(30) Foreign Application Priority Data

Mar. 25, 2013 (JP) ..... 2013-062547

(51) Int. Cl.
*B22C 5/04* (2006.01)
*B22C 15/02* (2006.01)

(52) U.S. Cl.
CPC ..... *B22C 15/02* (2013.01); *B22C 5/044* (2013.01); *B22C 5/049* (2013.01); *B22C 5/0413* (2013.01)

(58) Field of Classification Search
CPC ..... B22C 5/04; B22C 5/0413; B22C 5/044; B22C 5/049; B22C 15/02
USPC ..... 164/37, 207; 366/279
See application file for complete search history.

(56) References Cited

U.S. PATENT DOCUMENTS 6,745,818 B1 * 6/2004 Fan et al. ..... B22D 17/007 164/113

FOREIGN PATENT DOCUMENTS

| | | |
|---|---|---|
| JP | 60-223638 | 11/1985 |
| JP | 2013-180300 A | 9/2013 |
| WO | WO-2005/089984 A1 | 9/2005 |

OTHER PUBLICATIONS

English abstract for JP-2013-180300.

* cited by examiner

*Primary Examiner* — Kevin P Kerns
(74) *Attorney, Agent, or Firm* — Fishman Stewart PLLC

(57) ABSTRACT

A mold-making device may include a stirring device including a stirring tank and at least one stirring blade. The stirring device may further include a packing port that is configured to open and close on a bottom of the stirring tank. The stirring device may stir a particulate aggregate and at least one additive by rotating the at least one stirring blade within the stirring tank to yield an admixture. A forming mold may communicate with the packing port and mold the admixture into a predetermined shape. A packing device may compress a surface of the admixture within the stirring tank and pack the admixture into the forming mold via the packing port.

20 Claims, 7 Drawing Sheets

MOLD-MAKING DEVICE AND MOLD-MAKING METHOD

CROSS-REFERENCE TO RELATED APPLICATIONS

This application claims priority to Japanese Patent Application No. 2013-062547, filed Mar. 25, 2013, and International Patent Application No. PCT/JP2014/052936, filed Feb. 7, 2014, both of which are hereby incorporated by reference in their entirety.

TECHNICAL FIELD

The present invention relates to a mold-making device and a mold-making method, and more specifically to a mold-making device and a mold-making method in which a particulate aggregate and an additive(s) are stirred within a stirring tank to yield an admixture, the stirring tank is joined to a forming mold, and the surface of the admixture within the stirring tank is compressed to pack the admixture into the forming mold and mold a casting mold of a predetermined shape.

BACKGROUND

Conventionally, a casting mold such as a core of a predetermined shape is generally molded by stirring a particulate aggregate such as casting sand and an additive(s) such as a binder, surfactant, water, and the like with a stirring device to yield an admixture, and then packing the admixture into a cavity within a forming mold. A stirring device generally includes a stirring tank into which the particulate aggregate and the additive(s) are introduced, and stirring blades that are rotated within the stirring tank. In a general configuration of stirring blades, panel-shaped stirring blades 2' are provided around a rotating drive shaft 23' connected to a motor as shown in FIGS. 9 and 10.

For example, PCT International Publication No. WO 2005/089984 A is known as a conventional technology related to a mold-making device. As an example of a device for molding a casting mold in which a casting mold is molded by using a water-soluble binder as a binder for a particulate aggregate and hardening the water-soluble binder by heating it to evaporate any moisture therein, WO 2005/089984 A discloses a device including a cylinder extending in an up-down direction, a plunger disposed in the cylinder so that it can move up and down, and a gate for opening and closing an opening at the bottom end of the cylinder, in which the cylinder, plunger, and gate are provided such that they can be raised and lowered and constitute a means for injecting a fluid particulate aggregate into a metallic mold, and a mixer that obtains the fluid particulate aggregate is connected to an opening disposed at the center of the cylinder (Paragraphs [0002] and [0003]).

WO 2005/089984 A also discloses a device for molding a casting mold that includes the following: an admixture storage means that functions as a stirring tank and as an injection tube, a stirring blade mechanism that stirs and foams a particulate aggregate, a water-soluble binder, and water within the admixture storage means, a plugging means that blocks an injection hole of the admixture storage means, and a compression mechanism that compresses the admixture within the admixture storage means to inject the admixture into a cavity of a horizontally-divided metallic mold from the injection hole of the admixture storage means (Paragraphs [0018] to [0021]).

In the procedure for molding a casting mold using the device for molding a casting mold disclosed in WO 2005/089984 A, after closing the injection hole by the plugging means, the particulate aggregate, the water-soluble binder, and the water are introduced into the admixture storage means, the stirring blades of the stirring blade mechanism are rotated to stir and foam the particulate aggregate, the water-soluble binder, and the water to produce an admixture. Next, the stirring blades of the stirring blade mechanism are raised up and the plug of the plugging means is removed from the injection hole to open the injection hole, and then the admixture storage means is transported directly above the horizontally- and vertically-divided metallic mold that has been heated up. Subsequently, an upper metallic mold is placed on a lower metallic mold and then the admixture storage means is placed on the upper metallic mold or the vertically-divided metallic mold, or a stationary mold and a movable mold are closed and a lower surface of the admixture storage means is abutted to an upper surface of the metallic mold. A piston of the compression mechanism is then lowered, and after air between the piston and the admixture is discharged from an air vent hole while the piston is being lowered, a top end opening of the air vent hole is closed with a valve means (not illustrated). Thereby, the admixture within the admixture storage means is compressed so as to inject and pack the admixture into a cavity of the horizontally-divided metallic mold (Paragraphs [0031] to [0034]).

CITATION

Literature 1: PCT International Publication WO 2005/089984

SUMMARY

However, in the conventional technology described above, in the case that the panel-shaped stirring blades 2' are utilized as shown in FIGS. 9 and 10, the particulate aggregate and the additive(s) are stirred across the entire surface of the panel-shaped stirring blades 2'. Therefore, waves may be generated on the surface of an admixture M that exhibits fluidity, or the admixture may move toward the outside in the radial direction of the rotational trajectory of the stirring blades due to centrifugal forces, and thereby irregular unevenness may be formed on the surface of the admixture M as shown in FIG. 9.

Further, in the panel-shaped stirring blades 2', when stirring the particulate aggregate and the additive(s), a relatively large amount of the admixture of the particulate aggregate and the additive(s) adheres across the entire surface of the panel-shaped stirring blades 2' as shown in FIG. 9. If these kind of panel-shaped stirring blades 2' are used in the stirring blade mechanism disclosed in WO 2005/089984 A, when the stirring blades 2' are raised up and pulled out to remove them from the admixture M as shown in FIG. 10 before compressing the admixture M that has been produced by the piston of the compression mechanism for packing the admixture M into the cavity of the horizontally-divided metallic mold, the relatively large amount of the admixture M that has adhered to the panel-shaped stirring blades 2' may drip off, leading to the formation of irregular unevenness on the surface of the admixture M within the stirring tank 1'.

In addition, if the stirring mechanism is configured by providing the panel-shaped stirring blades 2' on the periphery of the rotating drive shaft 23' as shown in FIG. 9, the rotating drive shaft 23' is also immersed in the admixture M together with the stirring blades 2' during stirring. Thus, when the stirring blades 2' are raised up after completing the stirring and pulled out to remove them from the admixture M as shown in FIG. 10, a vestige of the rotating drive shaft 23' may remain in the admixture M, thereby forming a concavity Q.

As described above, if irregular unevenness or the like caused by pulling out the stirring blades 2' from the admixture M is formed on the surface of the admixture M, when the surface of the admixture M is subsequently compressed by a packing device 5' to pack the admixture M into a cavity 40' of a forming mold 4' as shown in FIG. 11, air B that exists in concavities on the surface of the admixture M gets trapped in the admixture M. In FIG. 11, 41' represents a passage, 51' represents a piston, and 51*a*' represents a compressing part. Even if an air vent hole is provided in the piston of the compression mechanism as is disclosed in WO 2005/089984 A (the compression mechanism corresponds to the packing device of the present invention), if the concavities on the surface of the admixture M are positioned at a portion where no air vent hole is disposed, the admixture M is packed into the cavity 40' of the forming mold 4' in a state in which the air B that exists in such concavities is trapped in the admixture M.

In any case, if the admixture M is packed into the cavity 40' of the forming mold 4' in a state in which the air B is trapped therein, packing deficiencies may occur on the surface of the casting mold that is molded, and as a result, the casting mold cannot be molded with good precision.

In addition, if the stirring mechanism is configured by providing the panel-shaped stirring blades 2' on the periphery of the rotating drive shaft 23' as shown in FIGS. 9 and 10, the particulate aggregate and the additive(s) are not sufficiently stirred at the base side of the stirring blades 2' (near the rotating shaft, or in other words near the center of the stirring tank 1'). Therefore, there has been a problem in that the admixture M of the particulate aggregate and the additive(s) becomes clustered on the distal end side (the side at the inner peripheral surface of the stirring tank) of the stirring blades 2', and thus the particulate aggregate and the additive(s) cannot be uniformly mixed in the stirring tank 1'.

Further, in WO 2005/089984 A, there has been a problem in that it is necessary to provide not only an air vent hole in the piston but also an air vent valve, and thus the configuration is complex and control of the air vent valve is complicated.

The present invention was created in consideration of the above-described problems, and an object thereof is to provide a device and method in which, when a particulate aggregate and an additive(s) are stirred to yield an admixture and then stirring blades are pulled out and removed from the admixture so that the surface of the admixture can be compressed within a stirring tank by a packing device and packed into a cavity of a forming mold to mold a casting mold, the surface of the admixture within the stirring tank that is to be compressed by the packing device can be smoothed out with a simple configuration, and thereby the casting mold can be molded with good precision.

To achieve the above object, according to an invention regarding a mold-making device pursuant to a first aspect, a mold-making device includes: a stirring device comprising a stirring tank and stirring blades, wherein the stirring device has a packing port that can open/close on a bottom of the stirring tank, and the stirring device stirs a particulate aggregate and an additive(s) by rotating the stirring blades within the stirring tank to yield an admixture; a forming mold that communicates with the packing port of the stirring tank and molds the admixture into a predetermined shape; and a packing device that compresses a surface of the admixture within the stirring tank and packs the admixture into the forming mold via the packing port, wherein scrapers for smoothing out the surface of the admixture are provided on a bottom of the stirring blades.

To achieve the above object, according to an invention regarding a mold-making device pursuant to a second aspect, a mold-making device includes: a stirring device comprising a stirring tank and stirring blades, wherein the stirring device has a packing port that can open/close on a bottom of the stirring tank, and the stirring device stirs a particulate aggregate and an additive(s) by rotating the stirring blades within the stirring tank to yield an admixture; a forming mold that communicates with the packing port of the stirring tank and molds the admixture into a predetermined shape; and a packing device that compresses a surface of the admixture within the stirring tank and packs the admixture into the forming mold, wherein the stirring blades are configured in a lattice pattern.

To achieve the above object, according to an invention regarding a mold-making device pursuant a third aspect, a mold-making device includes: a stirring device comprising a stirring tank and stirring blades, wherein the stirring device has a packing port that can open/close on a bottom of the stirring tank, and the stirring device stirs a particulate aggregate and an additive(s) by rotating the stirring blades within the stirring tank to yield an admixture; a forming mold that communicates with the packing port of the stirring tank and molds the admixture into a predetermined shape; and a packing device that compresses a surface of the admixture within the stirring tank and packs the admixture into the forming mold via the packing port, wherein a distal end of a rotating drive shaft is bonded to a top edge of the stirring blades.

Further, to achieve the above object, according to an invention regarding a mold-making method pursuant to a fourth aspect, a mold-making method includes: introducing a particulate aggregate and an additive(s) into a stirring tank in a state in which a packing port provided on a bottom of the stirring tank is closed, and stirring the particulate aggregate and the additive(s) by rotating stirring blades to yield an admixture; pulling out and removing the stirring blades from the admixture, and joining the packing port provided on the bottom of the stirring tank with a forming mold so that they are in communication and then opening the packing port; and compressing a surface of the admixture within the stirring tank and packing the admixture into the forming mold via the packing port to mold the admixture into a predetermined shape, wherein scrapers for smoothing out the surface of the admixture are provided on a bottom of the stirring blades, and the stirring blades are pulled out from the admixture while being rotated.

To achieve the above object, according to an invention regarding a mold-making method pursuant to a fifth aspect, a mold-making method includes: introducing a particulate aggregate and an additive(s) into a stirring tank in a state in which a packing port provided on a bottom of the stirring tank is closed, and stirring the particulate aggregate and the additive(s) by rotating stirring blades to yield an admixture; pulling out and removing the stirring blades from the admixture, and joining the packing port provided on the bottom of the stirring tank with a forming mold so that they are in communication and then opening the packing port; and compressing a surface of the admixture within the stirring tank and packing the admixture into the forming mold via the packing port to mold the admixture into a predetermined shape, wherein the particulate aggregate and the additive(s) are stirred using the stirring blades which are configured in a lattice pattern.

To achieve the above object, according to an invention regarding a mold-making method pursuant to a sixth aspect, a mold-making method includes: introducing a particulate aggregate and an additive(s) into a stirring tank in a state in which a packing port provided on a bottom of the stirring tank is closed, and stirring the particulate aggregate and the additive(s) by rotating stirring blades to yield an admixture; pulling out and removing the stirring blades from the admixture, and joining the packing port provided on the bottom of the stirring tank with a forming mold so that they are in communication and then opening the packing port; and compressing a surface of the admixture within the stirring tank and packing the admixture into the forming mold via the packing port to mold the admixture into a predetermined shape, wherein the particulate aggregate and the additive(s) are stirred using the stirring blades to which a distal end of a rotating drive shaft is attached at a top edge thereof.

In each invention pursuant to the first and fourth aspects, scrapers for smoothing out the surface of the admixture can be provided along a bottom edge of the stirring blades in a different phase than that of the stirring blades so as to have a predetermined angle relative to the stirring blades.

In each invention pursuant to the second and fifth aspect, the stirring blades configured in a lattice pattern can be configured by incorporating either one or both of a plurality of horizontal members and a plurality of vertical members. Further, the stirring blades configured in a lattice pattern can be configured to include a frame to which the ends of the horizontal members and the vertical members are bonded.

In each invention pursuant to the third and sixth aspect, the rotating drive shaft should be configured such that it is not immersed in the admixture or is only slightly immersed in the admixture. Thus, bonding the distal end of the rotating drive shaft to the top edge of the stirring blades can also substantially include the following case: the rotating shaft, whose diameter is equal to or less than the thickness of the stirring blades, includes a portion that extends downwards below the top end of the stirring blades, this portion is formed to be relatively thin with a diameter that is equal to or less than the thickness of the stirring blades, the stirring blades are provided on this portion, and a portion of the rotating drive shaft above the top edge of the stirring blades is formed to be relatively thick with a diameter that provides the strength necessary for rotational driving.

Regarding each invention pursuant to the first and second aspect, the particulate aggregate and the additive(s) are introduced in a state in which a packing port on the bottom of the stirring tank is closed, the particulate aggregate and the additive(s) are stirred by rotating the stirring blades within the stirring tank to yield an admixture, and then the stirring blades are pulled out and removed from the admixture. At this time, since scrapers are provided on the bottom of the stirring blades, if the stirring blades are pulled out from the admixture while being rotated, the scrapers will smooth out the surface of the admixture. Thus, even if irregular unevenness is formed on the surface of the admixture, this unevenness can be smoothed out.

Regarding each invention pursuant to the second and fifth aspect, the particulate aggregate and the additive(s) are introduced in a state in which a packing port on the bottom of the stirring tank is closed, and the particulate aggregate and the additive(s) are stirred by rotating the stirring blades within the stirring tank to yield an admixture. At this time, since the stirring blades are configured in a lattice pattern, the particulate aggregate and the additive(s) are stirred while passing through the lattice. Thus, the particulate aggregate and the additive(s) can be appropriately stirred to yield the admixture without generating any waves on the surface or causing clustering of the admixture on the outside in the radial direction within the stirring tank. Subsequently, the stirring blades are pulled out and removed from the admixture. At this time, since the stirring blades are configured in a lattice pattern, the surface area on which the admixture can adhere is reduced compared to panel-shaped stirring blades, and thus the amount of admixture that adheres to the stirring blades configured in a lattice pattern is extremely small. Therefore, even when pulling out and removing the stirring blades from the admixture, there are extremely few occurrences of admixture that has adhered to the stirring blades dripping off onto the surface of the admixture within the stirring tank. Accordingly, the formation of irregular unevenness on the surface of the admixture within the stirring tank can be prevented.

Regarding each invention pursuant to the third and sixth aspect, the particulate aggregate and the additive(s) are introduced in a state in which a packing port on the bottom of the stirring tank is closed, the particulate aggregate and the additive(s) are stirred by rotating the stirring blades within the stirring tank to yield an admixture, and then the stirring blades are pulled out and removed from the admixture. At this time, since the distal end of the rotating drive shaft is bonded to the top edge of the stirring blades, the particulate aggregate and the additive(s) can be stirred across the entire surface up to the inside in the radial direction of the rotational trajectory of the stirring blades. Also, rotating drive shaft is not immersed in the admixture or is only immersed in the admixture to a small depth, there is no formation of vestiges in the admixture left by the space at which the rotating drive shaft is positioned. Therefore, the formation of a concavity by the rotating drive shaft on the surface of the admixture when pulling out and removing the stirring blades from the admixture can be prevented, and the surface of the admixture can be smoothed out.

According to each invention described hereinabove, even if unevenness is formed on the surface of the admixture within the stirring tank, this unevenness can be smoothed out. Thus, air bubbles are not formed on the surface of the admixture when compressing the surface of the admixture within the stirring tank by the packing device to pack the admixture into the forming mold. As a result, packing of the admixture into the cavity in a state in which air bubbles are trapped in the admixture is eliminated, and thus packing deficiencies do not occur on the surface of the casting mold that is molded and the casting mold can be molded with good precision.

DETAILED DESCRIPTION

Figure 1:
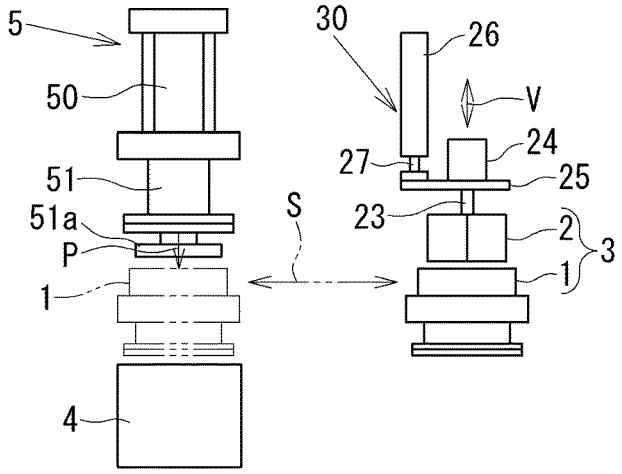
FIG. 1 is a front surface view schematically illustrating an embodiment of the overall mold-making device of the present invention.
Figure 2:
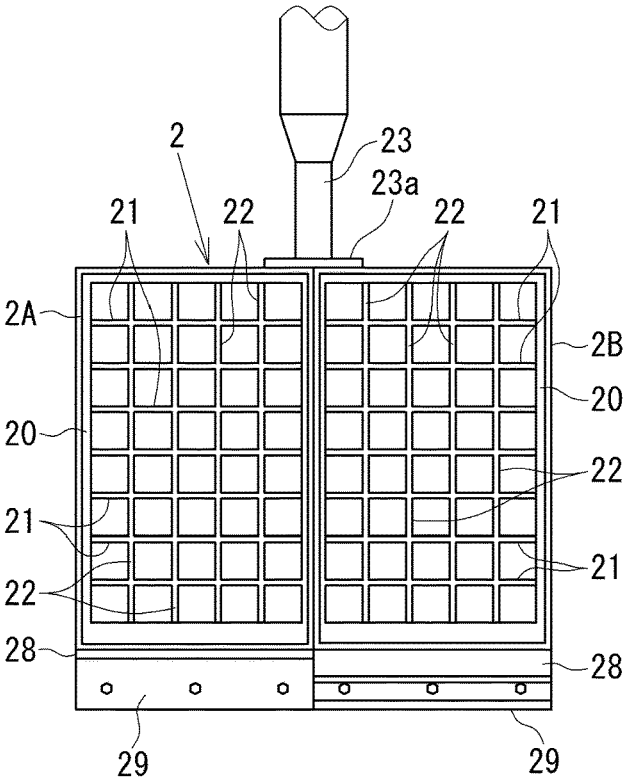
FIG. 2 is a partially enlarged view of the embodiment of the present invention for explaining a case in which a distal end of a rotating drive shaft is bonded to the top edge of stirring blades that are configured in a lattice pattern and scrapers are provided on a bottom of the stirring blades.

First, an embodiment of the mold-making device of the present invention will be explained in detail referring to FIGS. 1 to 4. In this embodiment, a case in which the casting mold to be molded is a core will be explained. In the drawings, identical or corresponding portions are assigned the same reference numeral.

The mold-making device basically includes the following: a stirring device 3 that includes a stirring tank 1 and stirring blades 2 for stirring a particulate aggregate and an additive(s) to yield an admixture M, a forming mold 4 for molding the admixture M into a predetermined shape, and a packing device 5 for compressing the surface of the admixture M within the stirring tank 1 to pack the admixture M into the forming mold 4. In this embodiment, the mold-making device also includes a stirring blade moving means 30 that moves the stirring blades 2 to remove them from the inside of the stirring tank 1 to the outside as shown by arrow V in FIG. 1, and a stirring tank moving means that moves the stirring tank 1 between the forming mold 4 and the packing device 5 as shown by arrow S in FIG. 1 in a state in which the stirring blades 2 have been removed from the inside of the stirring tank 1. In addition, the stirring tank 1 includes a packing port 10 (illustrated only in FIG. 8) on the bottom thereof, as well as an opening/closing means for controllably performing an opening/closing operation so as to close the packing port 10 during stirring and open the packing port 10 during packing of the admixture M into the forming mold 4.

Figure 8:
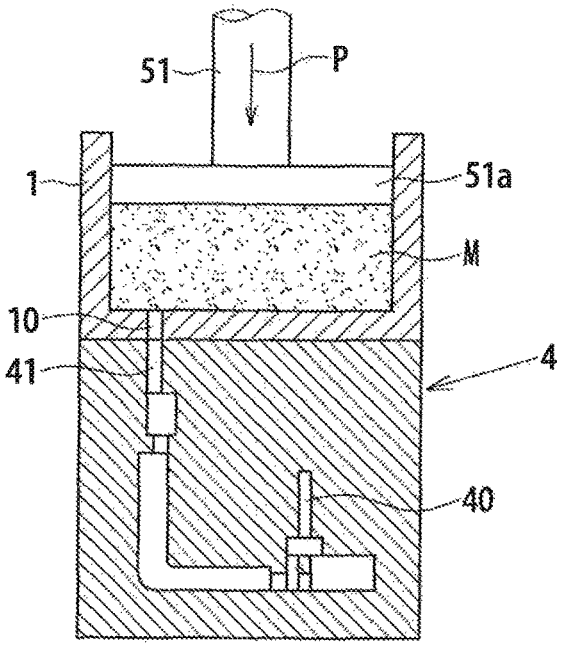
FIG. 8 is a partial vertical cross-section front view for explaining a state in which the surface of the admixture within the stirring tank is compressed by a packing device to pack the admixture into a forming mold via a packing port.
Figure 9:
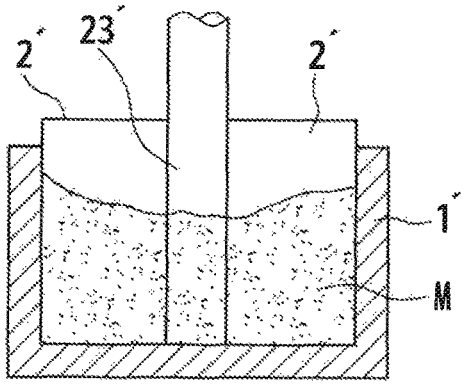
FIG. 9 PRIOR ART
FIG. 9 is a partial vertical cross-section front view of a conventional embodiment for explaining a state in which panel-shaped stirring blades are rotated within a stirring tank to stir a particulate aggregate and an additive(s) that have been introduced into the stirring tank.
Figure 10:
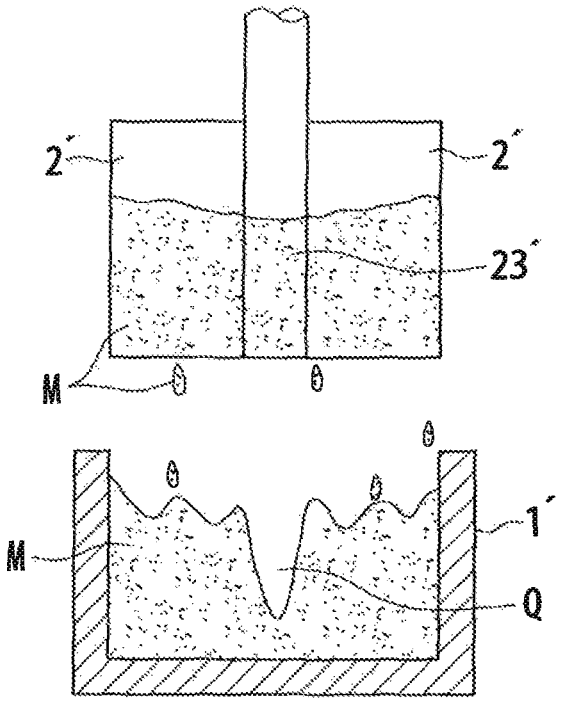
FIG. 10 PRIOR ART
FIG. 10 is a partial vertical cross-section front view of the conventional embodiment for explaining a situation in which admixture that has adhered to the stirring blades drips off when pulling out and removing the panel-shaped stirring blades from the admixture within the stirring tank.

The stirring tank 1 is formed into a closed-end cylinder and the top thereof is opened, and the packing port 10 which can communicate with a cavity 40 within the forming mold 4 is formed at the bottom of the stirring tank 1 as shown only in FIG. 8. The opening/closing means of the packing port 10 can be configured by, for example, a plugging member or a shutter.

Figure 4:
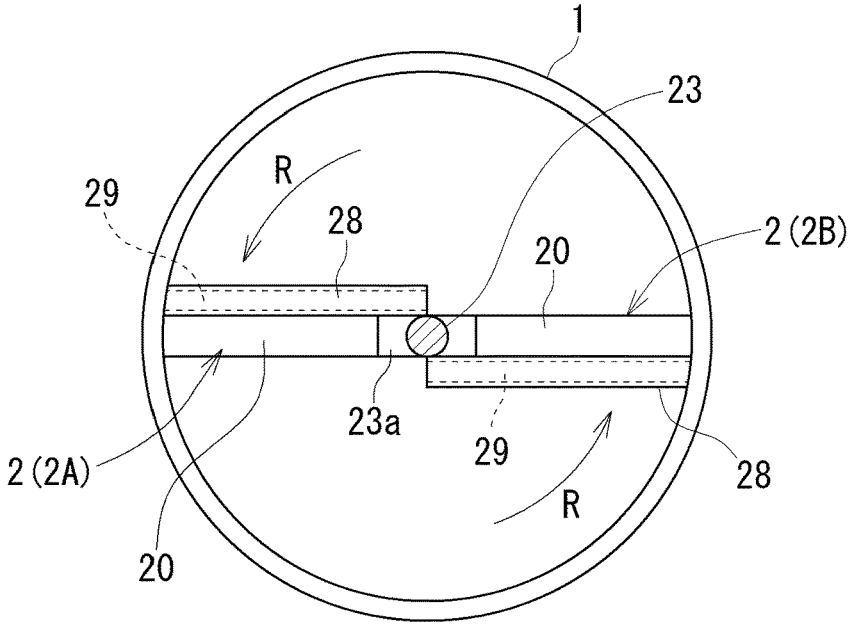
FIG. 4 is a plan view for explaining a state in which the stirring blades shown in FIG. 2 are rotated within a stirring tank.

In the case of the present embodiment, each stirring blade 2 includes a frame 20 having a width (length extending in the radial direction within the stirring tank 1) that is slightly smaller than the inner peripheral radius of the stirring tank 1 and height that is equal to or greater than a side wall of the stirring tank 1, a plurality of horizontal members 21, and a plurality of vertical members 22. In the present embodiment, as shown in FIG. 4, two frame bodies 20 and 20 are connected so as to be parallel to each other and mutually disposed at a phase of 180 degrees. The ends of the horizontal members 21 and the vertical members 22 are bonded to the frame 20. The horizontal members 21 and the vertical members 22 can be configured by wires or rods. The horizontal members 21 and the vertical members 22 can be disposed intersecting each other so as to be parallel, or can be disposed intersecting each other so as to be interwoven together. Portions where the horizontal members 21 and the vertical members 22 intersect each other can be bonded by welding or the like as necessary. The stirring blades 2 are not limited to being configured by two blades (in a phase of 180 degrees), and can be configured by three blades (in a phase of 120 degrees) or four blades (in a phase of 90 degrees) as necessary. The stirring blades 2 configured in a lattice pattern are not limited to the horizontal members 21 and the vertical members 22, and wires or rods can be provided on the frame 20 to intersect each other at a predetermined angle relative to a horizontal or vertical direction.

Figure 3:
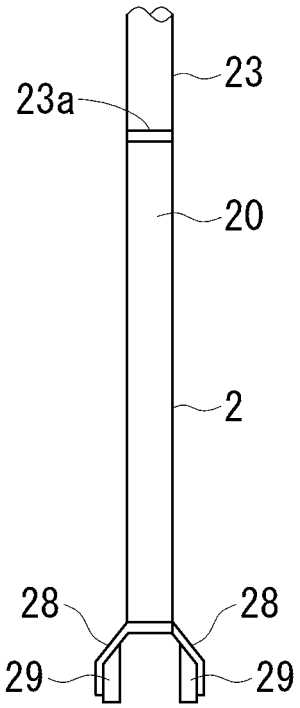
FIG. 3 is a side surface view of FIG. 2.

A rotating drive shaft 23 for rotatably driving the stirring blades 2 is formed with a small diameter such that a distal end of the rotating drive shaft 23 is equal to or less than the width (thickness) of the frame 20 as shown in FIG. 3, and the rotating drive shaft 23 has an attachment piece 23*a* on the distal end surface thereof. The attachment piece 23*a* is bonded to the top edge of the frames 20 of the stirring blades 2. A motor 24 to which the rotating drive shaft 23 is connected for rotating the stirring blades 2 within the stirring tank 1 is supported by a support member 25. The support member 25 is connected to a piston rod 27 of a cylinder 26 that constitutes the stirring blade moving means 30. In the present embodiment, if the piston rod 27 of the cylinder 26 is driven to elongate as shown by arrow V in FIG. 1, the stirring blades 2 are lowered to enter the stirring tank 1, and if the piston rod 27 of the cylinder 26 is driven to retract, the stirring blades 2 are raised to retreat from the inside of the stirring tank 1. The stirring blade moving means 30 is not limited to the cylinder 26, and, for example, a ball screw mechanism or the like can be used as long as it can raise/lower the stirring blades in the axial direction of the rotating drive shaft.

Scrapers 29 are provided on the bottom of the frames 20 of the stirring blades 2 via attachment members 28 so as to extend parallel to the surface of the stirring blades 2 in the present embodiment. The attachment members 28 are formed to position the scrapers 29 on a rearward side of the frames 20 relative to the rotation direction of the stirring blades 2 shown by arrow R in FIG. 4 (in FIG. 2, one scraper 29 is offset toward the rear of the paper surface relative to a left-side stirring blade 2A, and one scraper 29 is offset toward the front of the paper surface relative to the right-side stirring blade 2B). For the scrapers 29, a material having a hardness that is suitable for smoothing out the surface of the admixture M as will be explained later can be selected. The scrapers 29 are not limited to being provided parallel to the stirring blades 2 and in a number corresponding to the stirring blades 2, and the scrapers 29 can be provided to extend at a predetermined angle relative to the surface of the stirring blades 2 as necessary, and can be provided in a number that differs from the number of the stirring blades 2 as necessary.

The stirring tank moving means (refer to arrow S in FIG. 1) includes rails or guide members that movably support the stirring tank 1 in the left-right direction in FIG. 1, and an actuator consisting of a cylinder or the like for moving the stirring tank 1.

The forming mold 4 is constituted by a plurality of metallic molds that can be opened and closed. When the molds are closed, a cavity 40 corresponding to a shape of a core to be molded and a passage 41 for enabling communication between the cavity 40 and the packing port 10 of the stirring tank 1 are formed. Also, the packing device 5 includes a cylinder 50 disposed above the forming mold 4, and a piston 51 that is inserted into the cylinder 50 and has a compressing part 51*a* on its distal end that enters the stirring tank 1 to compress the admixture M. In the present embodiment, as shown by arrow P in FIG. 1, when the piston 51 of the cylinder 50 is driven to elongate, the compressing part 51*a* is lowered to enter the stirring tank 1 and compress the surface of the admixture M, and when the piston 51 is driven to retract, the compressing part 51*a* is raised to retreat from the stirring tank 1. When the stirring tank 1 is moved under the packing device 5 by the stirring tank moving means (refer to arrow S in FIG. 1), a joining mechanism for bringing the forming mold 4 and the stirring tank 1 close to each other can be provided in order to join an opening of the passage 41 of the forming mold 4 with the packing port 10 of the stirring tank 1.

Next, an embodiment of the mold-making method of the present invention in the case of using the mold-making device constituted as described above will be explained together with the operation of the mold-making device referring mainly to FIGS. 5 to 8.

The mold-making method of the present invention is basically as follows: a particulate aggregate and an additive(s) are introduced into the stirring tank 1 in a state in which the packing port 10 provided on the bottom of the stirring tank 1 is closed; the stirring blades 2 are rotated to stir the particulate aggregate and the additive(s) to yield an admixture M; the stirring blades 2 are pulled out and removed from the admixture M; the packing port 10 provided on the bottom of the stirring tank 1 and the passage 41 of the forming mold 4 are joined so that they are in communication and then the packing port 10 is opened; and the surface of the admixture M within the stirring tank 1 is compressed to pack the admixture M into the cavity 40 of the forming mold 4 via the packing port 10 to mold the admixture M into a predetermined shape. When stirring the particulate aggregate and the additive(s), the stirring blades 2 that are used are configured in a lattice pattern and the distal end of the rotating drive shaft 23 is bonded to the top edge of the stirring blades 2. Further, in the mold-making method of the present invention, the scrapers 29 are provided on the bottom of the stirring blades 2, and the scrapers 29 are pulled out and removed from the admixture M while being rotated together with the stirring blades 2, and thereby the scrapers 29 smooth out the surface of the admixture M within the stirring tank 1.

When molding a casting mold of a predetermined shape such as a core, first, the stirring tank 1 is disposed under the stirring blades 2, and the packing port 10 on the bottom of the stirring tank 1 is put into a closed state by the opening/closing means. In this state, a particulate aggregate such as casting sand, which serves as the material for the casting mold, and an additive(s) such as a binder, a surfactant, water, and a foaming agent (as necessary) are introduced at predetermined proportions and amounts into the stirring tank 1 using a hopper or the like. Around this time, the piston rod 27 of the cylinder 26 that constitutes the stirring blade moving means 30 is driven to elongate so as to lower the stirring blades 2 that are bonded to the rotating drive shaft 23 connected to the motor 24 and insert the stirring blades 2 into the stirring tank 1. At this time, the stirring blades 2 can be lowered such that the scrapers 29 provided on the bottom of the stirring blades 2 contact the bottom of the stirring tank 1, or the stirring blades 2 can be lowered to a height at which a predetermined interval is formed between the scrapers 29 and the bottom of the stirring tank 1.

Figure 5:
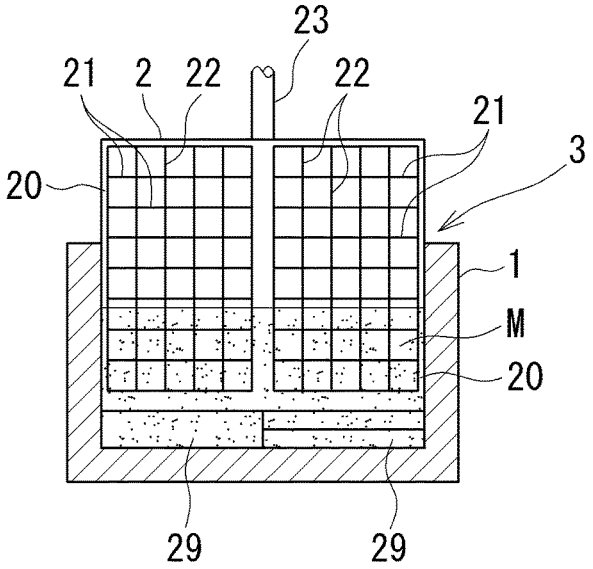
FIG. 5 is a partial vertical cross-section front view of the embodiment of the present invention for explaining a state in which the stirring blades are rotated within the stirring tank by a stirring device to stir a particulate aggregate and an additive(s) that have been introduced into the stirring tank.

Next, the stirring blades 2 that are bonded to the rotating drive shaft 23 are driven to rotate within the stirring tank 1 by the motor 24 to stir the particulate aggregate and the additive(s) to yield the admixture M. At this time, as shown in FIG. 5, since the stirring blades 2 are configured in a lattice pattern, when the stirring blades 2 are rotated within the stirring tank 1, the particulate aggregate and the additive(s) are stirred while passing between the horizontal members 21 and the vertical members 22 which are in a lattice pattern. Therefore, the occurrence of waves on the surface of the admixture M and clustering of the admixture M on the outside in the radial direction within the stirring tank 1 are reduced. The admixture M in the present embodiment becomes foamed sand. In the present invention, the height to which the stirring blades 2 are lowered into the stirring tank 1 by the cylinder 26 and the piston 27 that constitute the stirring blade moving means 30 as described above is not particularly limited regarding whether or not the scrapers 29 contact the bottom of the stirring tank 1. This is because the purpose for providing the scrapers 29 is not only to prevent the admixture M (including a state in which the particulate aggregate and the additive(s) are in the course of becoming the admixture M) from adhering to the bottom of the stirring tank 1 when stirring the particulate aggregate and the additive(s), but also to smooth out the surface of the admixture M as will be explained below. However, the present invention does not obstruct lowering the stirring blades 2 so that the scrapers 29 contact the bottom of the stirring tank 1 in order to prevent the adherence of the admixture M to the bottom of the stirring tank 1 by the scrapers 29.

Figure 6:
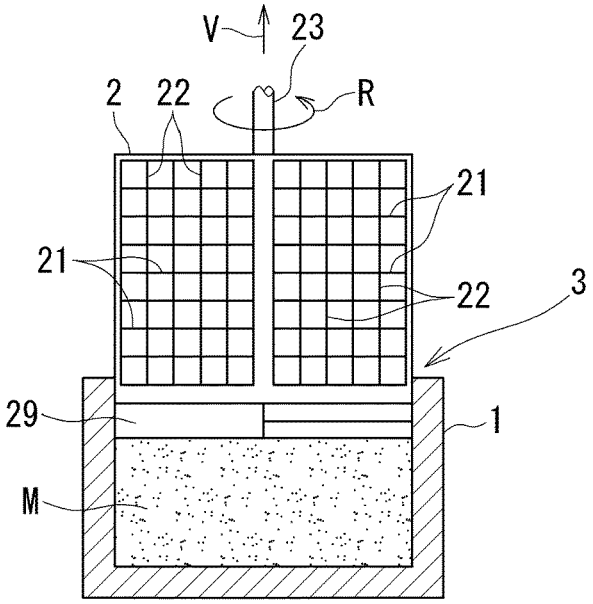
FIG. 6 is a partial vertical cross-section front view for explaining a state in which the stirring blades are pulled out from an admixture while being rotated from the state shown in FIG. 5 and a surface of the admixture is smoothed out by scrapers provided on the bottom of the stirring blades.

Once the admixture M is obtained, the piston 27 of the cylinder 26 is driven to retract and the stirring blades 2 are pulled out from the admixture M and removed to above the stirring tank 1 so that the stirring tank 1 can be moved between the forming mold 4 and the packing device 5. At this time, the piston 27 of the cylinder 26 is driven to retract and rise up while the motor 24 is driving the scrapers 29 to rotate together with the stirring blades 2. Thereby, as shown in FIG. 6, the scrapers 29 provided on the bottom of the stirring blades 2 smooth out the surface of the admixture M. Thus, the surface of the admixture M can be reliably smoothed out. When the bottom of the scrapers 29 have been raised up to the height of the surface of the admixture M within the stirring tank 1, the retraction of the piston 27 of the cylinder 26 can be controlled to be temporarily stopped to increase the time for smoothing out the surface of the admixture M.

Figure 7:
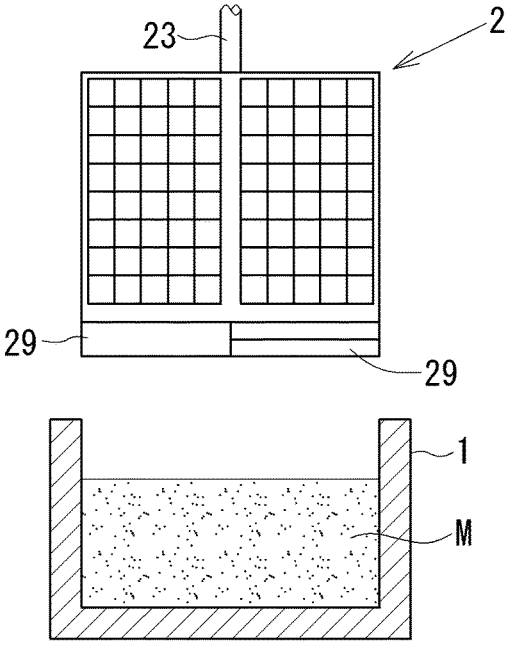
FIG. 7 is a partial vertical cross-section front view for explaining a state in which the stirring blades are further raised up and removed from the state shown in FIG. 6.

Herein, by configuring the stirring blades 2 in a lattice pattern, the surface area for adherence of the admixture M decreases compared to the conventional panel-shaped stirring blades 2'. Thus, the stirring blades 2 according to the present invention can reduce the amount of adhered admixture M compared to the conventional panel-shaped stirring blades 2'. Accordingly, with the stirring blades 2 of the present invention, the amount of admixture M adhered to the stirring blades 2 that drips off onto the surface of the admixture M within the stirring tank 1 when pulling out and removing the stirring blades 2 above from the admixture M is extremely small as shown in FIG. 7. As a result, the formation of irregular unevenness caused by the admixture M that has adhered to the stirring blades 2 dripping off onto the surface of the admixture M within the stirring tank 1 can be prevented.

Further, in the present invention, since the distal end of the rotating drive shaft 23 is bonded to the top edge of the stirring blades 2, which have a height that is taller than the side wall of the stirring tank 1, the rotating drive shaft 23 is not immersed into the admixture M, and thus there is no formation of vestiges on the surface of the admixture M caused by the space of the rotating drive shaft 23.

Figure 11:
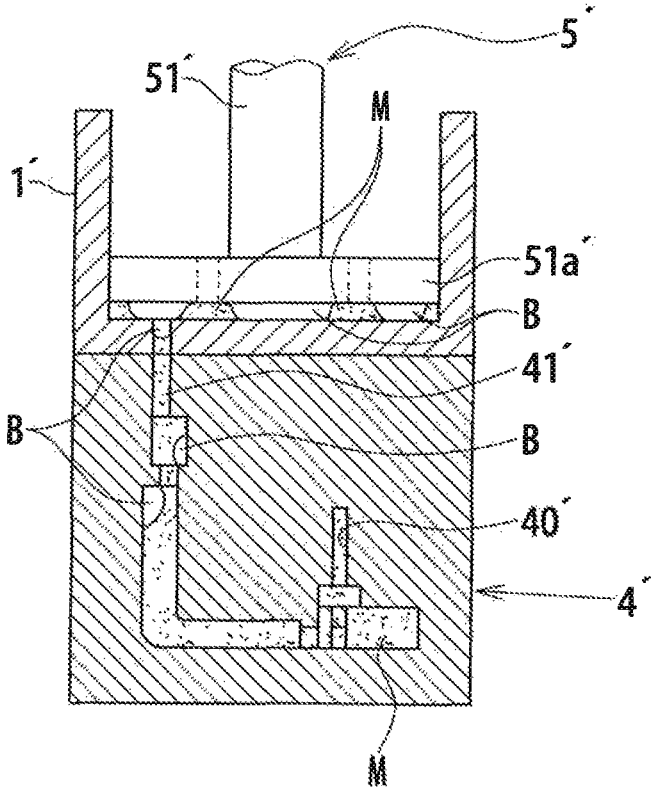
FIG. 11 PRIOR ART
FIG. 11 is a partial vertical cross-section front view of the conventional embodiment for explaining a case in which irregular unevenness is formed on the surface of the admixture within the stirring tank and the admixture is then compressed by a packing device to pack the admixture into a forming mold via a packing port, leading to the formation of a casting mold having packing deficiencies on the surface thereof.

When the stirring blades 2 are removed to above the stirring tank 1, the stirring tank 1 is moved between the forming mold 4 and the packing device 5 by the stirring tank moving means as shown by arrow S in FIG. 1. The packing port 10 (refer to FIG. 8) provided on the bottom of the stirring tank 1 is then aligned with an opening of the passage 41 of the forming mold 4, and the forming mold 4 and the stirring tank 1 are brought close to each other by the joining mechanism so as to join the opening of the passage 41 of the forming mold 4 to the packing port 10 of the stirring tank 1. Next, the packing port 10 at the bottom of the stirring tank 1 is put into an opened state by the opening/closing means. The piston 51 of the cylinder 50 of the packing device 5 is driven to elongate and the surface of the admixture M within the stirring tank 1 is compressed by the compressing part 51*a* at the distal end of the piston 51. Thereby, the admixture M is packed into the cavity 40 via the packing port 10 of the stirring tank 1 and the passage 41 of the forming mold 4. At this time, in the present invention, since the surface of the admixture M within the stirring tank 1 is smooth and no irregular unevenness has been formed as described above, air bubbles do not form between the surface of the admixture M and the compressing part 51*a*, and thus the admixture M is not packed into the cavity 40 in a state in which air is trapped in the admixture M. As a result, packing deficiencies due to trapped air (refer to reference numeral B in FIG. 11 which illustrates a conventional technology) on the surface of the core that has been molded do not occur, and thus the core can be molded with good precision.

In the present invention, the density of the vertical members and the horizontal members of the stirring blades provided on the frame can be modified according to the viscosity of the admixture and the like. Also, in the present invention, configuring the stirring blades in a lattice pattern, bonding the distal end of the rotating drive shaft to the top edge of the stirring blades, and raising up the scrapers provided on the bottom of the stirring blades while rotating the scrapers together with the stirring blades to smooth out the surface of the admixture can be appropriately combined.

EXPLANATION FOR REFERENCES

M: Admixture 1: Stirring Tank 2: Stirring Blade 3: Stirring Device 4: Forming Mold 5: Packing Device 10: Packing Port 20: Frame Body 21: Horizontal Member 22: Vertical Member 29: Scraper 30: Stirring Blade Moving Means 51*a*: Compressing Part

What is claimed is:

1. A mold-making device comprising:

a stirring device including a stirring tank and at least one stirring blade, the at least one stirring blade having a rotating drive shaft in a vertical direction, wherein the stirring device further includes a packing port that is configured to open and close on a bottom of the stirring tank, and wherein the stirring device stirs a particulate aggregate and at least one additive by rotating the at least one stirring blade within the stirring tank to yield an admixture;

a forming mold that communicates with the packing port of the stirring tank and molds the admixture into a predetermined shape;

a packing device configured to compress a surface of the admixture within the stirring tank and pack the admixture into the forming mold via the packing port; and at least one scraper for smoothing out the surface of the admixture is disposed on a bottom of the at least one stirring blade;

wherein the at least one stirring blade is adjustable in an axial direction of the rotating drive shaft and rotatable in a circumferential direction of the rotating drive shaft, and wherein the stirring device is configured to raise the at least one stirring blade along the axial direction so as to be pulled out from the admixture while rotating the at least one stirring blade together with the at least one scraper to facilitate smoothing out the surface of the admixture.

2. The mold-making device of claim 1, wherein the stirring device includes a plurality of stirring blades, and wherein the plurality of stirring blades are configured in a lattice pattern.

3. The mold-making device of claim 1, wherein the at least one stirring blade includes a plurality of intersecting members configured in a lattice pattern.

4. The mold-making device of claim 1, wherein the at least one stirring blade is coupled at a top edge to a distal end of the drive shaft.

5. The mold-making device of claim 4, wherein the at least one stirring blade includes a plurality of intersecting members configured in a lattice pattern.

6. A mold-making device comprising:

a stirring device including a stirring tank and a plurality of stirring blades, the stirring blades having a rotating drive shaft in a vertical direction, wherein the stirring device further includes a packing port that is configured to open and close on a bottom of the stirring tank, and wherein the stirring device stirs a particulate aggregate and at least one additive by rotating the plurality of stirring blades within the stirring tank to yield an admixture, the stirring blades being then raised along an axial direction of the rotating drive shaft so as to be pulled out from the admixture and removed above the stirring tank;

a forming mold that communicates with the packing port of the stirring tank and molds the admixture into a predetermined shape; and a packing device configured to compress a surface of the admixture within the stirring tank and pack the admixture into the forming mold;

wherein each stirring blade of the plurality of stirring blades is configured in a substantially planar lattice pattern.

7. The mold-making device of claim 6, wherein the substantially planar lattice pattern of each stirring blade of the plurality of stirring blades includes a plurality of first members intersecting with a plurality of second members.

8. The mold-making device of claim 6, further comprising a scraper disposed on a bottom of at least one of the plurality of stirring blades for smoothing out the surface of the admixture.

9. The mold-making device of claim 6, wherein the drive shaft is coupled at a distal end to a top edge of the plurality of stirring blades.

10. A sand mold-making device comprising:

a stirring device including a stirring tank and at least one stirring blade, the at least one stirring blade having a rotating drive shaft in a vertical direction, wherein the stirring device further includes a packing port that is configured to open and close on a bottom of the stirring tank, and wherein the stirring device stirs a particulate aggregate and at least one additive by rotating the at least one stirring blade within the stirring tank to yield an admixture, the at least one stirring blade being then raised along an axial direction of the rotating drive shaft so as to be pulled out from the admixture and removed above the stirring tank;

a forming mold that communicates with the packing port of the stirring tank and molds the admixture into a predetermined shape; and a sand packing device configured to compress a surface of the admixture within the stirring tank and pack the admixture into the forming mold via the packing port;

wherein the at least one stirring blade at a top edge is secured to a distal end of a rotating drive shaft.

11. The sand mold-making device of claim 10, further comprising a scraper disposed on a bottom of the at least one stirring blade for smoothing out the surface of the admixture.

12. The sand mold-making device of claim 10, wherein the at least one stirring blade includes a plurality of intersecting members configured in a lattice pattern.

13. A mold-making method comprising:

introducing a particulate aggregate and at least one additive into a stirring tank in a state in which a packing port disposed on a bottom of the stirring tank is closed, and stirring the particulate aggregate and the at least one additive by rotating at least one stirring blade to yield an admixture, the at least one stirring blade having a rotating drive shaft in a vertical direction;

raising the at least one stirring blade along an axial direction of the rotating drive shaft so as to be pulled out from the admixture and removed above the stirring tank, and coupling the packing port disposed on the bottom of the stirring tank with a forming mold so that the packing port and the forming mold are in communication with each other and then opening the packing port; and compressing a surface of the admixture within the stirring tank and packing the admixture into the forming mold via the packing port to mold the admixture into a predetermined shape;

wherein at least one scraper for smoothing out the surface of the admixture is arranged on a bottom of the at least one stirring blade; and wherein raising the at least one stirring blade includes rotating the at least one stirring blade together with the at least one scraper in a circumferential direction of the rotating drive shaft while being pulled out and removed from the admixture such that the at least one scraper smooths out the surface of the admixture.

14. The mold-making method of claim 13, wherein stirring the particulate aggregate and the at least one additive further includes rotating the drive shaft coupled at a distal end to a top edge of the at least one stirring blade.

15. A mold-making method comprising:

introducing a particulate aggregate and an additive into a stirring tank in a state in which a packing port disposed on a bottom of the stirring tank is closed, and stirring the particulate aggregate and the additive by rotating a plurality of stirring blades to yield an admixture, the plurality of stirring blades having a rotating drive shaft in a vertical direction;

raising the plurality of stirring blades along an axial direction of the rotating drive shaft so as to be pulled out from the admixture and removed above the stirring tank, and coupling the packing port on the bottom of the stirring tank with a forming mold and opening the packing port when the packing port and the forming mold are in communication with each other; and compressing a surface of the admixture within the stirring tank and packing the admixture into the forming mold via the packing port to mold the admixture into a predetermined shape;

wherein the particulate aggregate and the additive are stirred via the plurality of stirring blades, and wherein each stirring blade of the plurality of stirring blades is configured in a substantially planar lattice pattern.

16. The mold-making method of claim 15, wherein compressing a surface of the admixture further includes smoothing out the surface of the admixture via a scraper disposed on a bottom of at least one stirring blade of the plurality of stirring blades.

17. A sand mold-making method comprising:

introducing a particulate aggregate and an additive into a stirring tank in a state in which a packing port disposed on a bottom of the stirring tank is closed, and stirring the particulate aggregate and the additive by rotating at least one stirring blade to yield an admixture, the at least one stirring blade having a rotating drive shaft in a vertical direction;

raising the at least one stirring blade along an axial direction of the rotating drive shaft so as to be pulled out from the admixture and removed above the stirring tank, and coupling the packing port on the bottom of the stirring tank with a forming mold, and opening the packing port when the packing port and the forming mold are in communication with one another; and compressing a surface of the admixture within the stirring tank and packing the admixture into the forming mold via the packing port to mold the admixture into a predetermined shape;

wherein the particulate aggregate and the additive are stirred by the at least one stirring blade via a rotating drive shaft attached at a distal end to a top edge of the at least one stirring blade, and wherein the particulate aggregate includes sand.

18. The sand mold-making method of claim 17, wherein the at least one stirring blade includes a plurality of intersecting members configured in a lattice pattern.

19. The sand mold-making method of claim 17, further comprising removing the at least one stirring blade from the admixture while rotating the at least one stirring blade.

20. The sand mold-making method of claim 17, wherein the step of compressing a surface of the admixture further includes smoothing out the surface of the admixture via at least one scraper disposed on a bottom of the at least one stirring blade.

* * * * *